US011046095B2

(12) United States Patent
Wong et al.

(10) Patent No.: US 11,046,095 B2
(45) Date of Patent: Jun. 29, 2021

(54) PRINTER

(71) Applicant: TOSHIBA TEC KABUSHIKI KAISHA, Tokyo (JP)

(72) Inventors: John Huang Ung Wong, Singapore (SG); Kenji Eoka, Singapore (SG); Yun Reng Loh, Singapore (SG)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/595,699

(22) Filed: Oct. 8, 2019

(65) Prior Publication Data

US 2020/0198375 A1 Jun. 25, 2020

(30) Foreign Application Priority Data

Dec. 21, 2018 (JP) ..... JP2018-239616

(51) Int. Cl.
*B41J 11/04* (2006.01)
*B41J 3/407* (2006.01)
*B41J 15/16* (2006.01)

(52) U.S. Cl.
CPC ..... *B41J 11/04* (2013.01); *B41J 3/4075* (2013.01)

(58) Field of Classification Search
CPC . B41J 15/00; B41J 15/005; B41J 15/04; B41J 15/044; B41J 15/06; B41J 15/165; B41J 11/0045; B41J 11/006; B65H 26/04; B65H 23/16; B65H 23/26
See application file for complete search history.

(56) References Cited

U.S. PATENT DOCUMENTS

| | | | | |
|---|---|---|---|---|
| 3,649,447 | A | 3/1972 | Turner | |
| 5,911,382 | A * | 6/1999 | Wilson | B65H 23/16 101/228 |
| 10,457,515 | B2 * | 10/2019 | Hagi | B65H 23/34 |
| 2017/0038721 | A1 | 2/2017 | Hara | |

FOREIGN PATENT DOCUMENTS

| | | |
|---|---|---|
| JP | 11-246093 | 9/1999 |
| JP | 2004-075202 | 3/2004 |
| JP | 2019-151011 | 9/2019 |

OTHER PUBLICATIONS

Extended European Search Report for European Patent Application No. 19210307.5 dated May 27, 2020.

* cited by examiner

*Primary Examiner* — Scott A Richmond
(74) *Attorney, Agent, or Firm* — Amin, Turocy & Watson, LLP

(57) ABSTRACT

In accordance with an embodiment, a printer comprises a housing section configured to accommodate a roll body obtained by winding an elongated image receiving medium in a roll shape; a conveyance section configured to pull out the image receiving medium from the roll body to convey it; a printing section configured to perform printing on the image receiving medium pulled out of the roll body by the conveyance section; and a buffer device arranged at the bottom of the housing section on an upstream side of the conveyance section along a direction in which the image receiving medium is pulled out by the conveyance direction so as to apply a pressing force in a direction towards the roll body to the image receiving medium pulled out of the roll body.

7 Claims, 7 Drawing Sheets

PRINTER

CROSS-REFERENCE TO RELATED APPLICATION

This application is based upon and claims the benefit of priority from Japanese Patent Application No. 2018-239616, filed on Dec. 21, 2018, the entire contents of which are incorporated herein by reference.

FIELD

Embodiments described herein relate generally to a printer that conveys an image receiving medium pulled out of, for example, a roll body obtained by winding an elongated image receiving medium in a roll shape and performs printing on the conveyed image receiving medium.

BACKGROUND

A conventional printer conveys an image receiving medium pulled out of a roll body obtained by winding an elongated image receiving medium in a roll shape and performs printing on the conveyed image receiving medium. Such a type of printer has a tension applying mechanism for absorbing impact at the start of conveying the image receiving medium by applying tension to the image receiving medium on an upstream side of a print head to stabilize a print quality.

DETAILED DESCRIPTION

In accordance with an embodiment, a printer comprises a housing section configured to accommodate a roll body obtained by winding an elongated image receiving medium in a roll shape; a conveyance section configured to pull out the image receiving medium from the roll body to convey it; a printing section configured to perform printing on the image receiving medium pulled out of the roll body by the conveyance section; and a buffer device arranged at the bottom of the housing section on an upstream side of the conveyance section along a direction in which the image receiving medium is pulled out by the conveyance direction so as to apply a pressing force in a direction towards the roll body to the image receiving medium pulled out of the roll body.

Hereinafter, an embodiment is described in detail with reference to the accompanying drawings.

Figure 1:
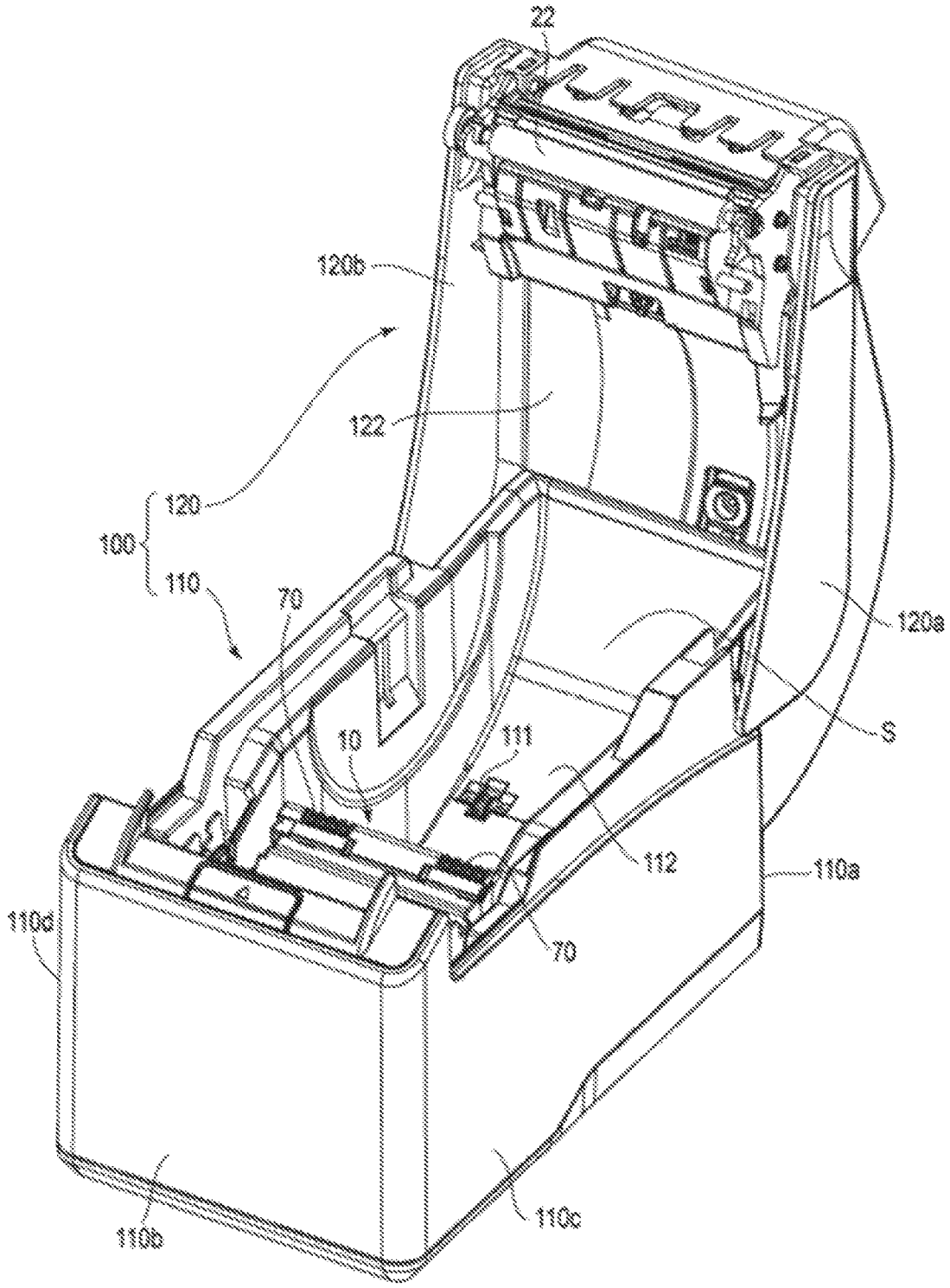
FIG. 1 is a perspective view of a printer according to an embodiment.

FIG. 1 is a perspective view illustrating a state in which a printer 100 according to the embodiment is placed on a predetermined horizontal plane. As shown in FIG. 1, the printer 100 according to the embodiment includes a housing 110 having a substantially rectangular box shape with an opening formed on an upper surface side thereof. The printer 100 also has a cover body 120 that covers the upper surface side of the housing 110. The cover body 120 is connected in the vicinity of one end (a right end in FIG. 1) in a longitudinal direction of the housing 110 via a hinge (not shown), and opens and closes the opening on the upper surface side of the housing 110. For convenience of description, the one end side where the hinge of the printer 100 is provided is referred to as a rear side, and the opposite side thereof is referred to as a front side. FIG. 1 shows a state in which the cover body 120 is fully opened with respect to the housing 110.

Figure 2:
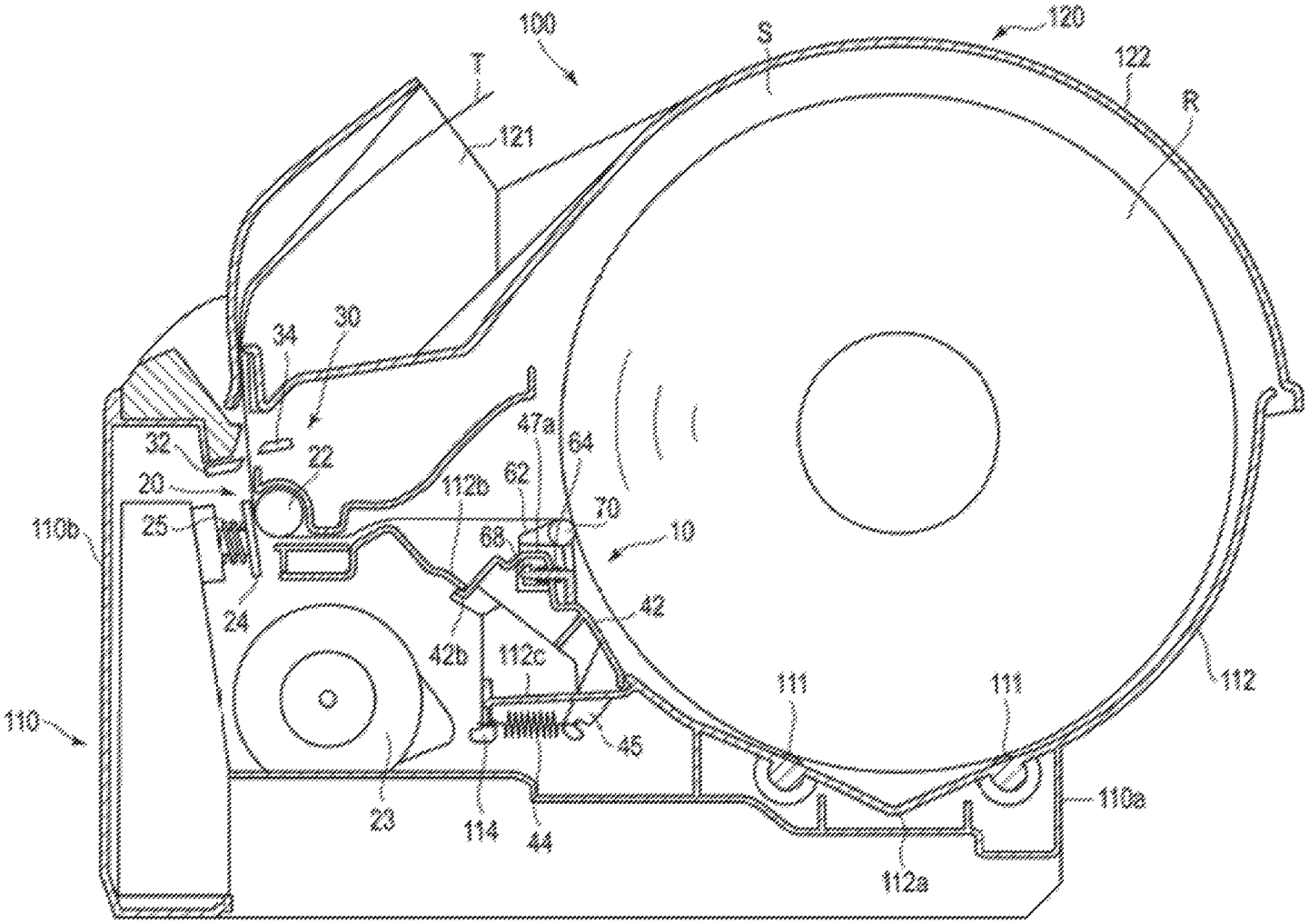
FIG. 2 is a sectional view schematically illustrating the printer in FIG. 1.

As shown in FIG. 2, the housing 110 has a space communicating with the above-described opening. A bottom wall 112 positioned on the rear side below the space is formed in a substantially arcuate shape that curves from a rear side end of the opening towards a front side end thereof. A space between the bottom wall 112 and the above-described opening has a semi-cylindrical shape like a lower half of a cylinder horizontally laid down. In this space, a roll body R obtained by winding an elongated recording paper T (i.e., the image receiving medium) with a predetermined width in a roll shape is accommodated in a freely rotatable state. A lower portion of the roll body R is fit in the semi-cylindrical space when the roll body R is horizontally laid down. An outer circumferential surface of the roll body R that fits in the space extends along the arc of the bottom wall 112. A curvature radius of the bottom wall 112 is slightly greater than that of the unused roll body R with the maximum diameter. This is because the outer shape of the roll body R gradually decreases as the recording paper T is pulled away from the outer circumference of the roll body R. A size in a width direction of the bottom wall 112 is slightly greater than a width in an axial direction of the roll body R. The width direction of the bottom wall 112 is parallel to the axial direction of the above-described hinge.

The outer side of the housing 110 has four side walls 110*a*, 110*b*, 110*c* and 110*d* (FIG. 1) extending in a vertical direction. The side wall 110*a* on the rear side of the housing 110 is lower in the vertical direction than the other side walls 110*b*, 110*c* and 110*d*. A part of the bottom wall 112 protrudes outward from an upper end of the side wall 110*a*. In other words, the bottom wall 112 includes a portion that protrudes from the upper end of the side wall 110*a* to the outside of the side wall 110*a* and a portion that extends to the inside of the side wall 110*a*, which are continuous to each other.

The bottom wall 112 has a shape in which the lowermost end thereof is bent into an obtuse V shape, and a bent portion 112*a* thereof is positioned at the inside of the side wall 110*a*. A portion of the bottom wall 112 on the front side of the bent portion 112*a* is inclined upward to extend substantially straight. The printer 100 includes a buffer device 10 described below at the portion of the bottom wall 112 extending substantially straight.

The bottom wall 112 has a plurality of rotatable support rollers 111. The plurality of support rollers 111 is provided at symmetrical positions with the bent portion 112*a* as a center. Each of the support rollers 111 includes two roller portions coaxially arranged in a mutually separated manner. Each of the support rollers 111 is attached to the bottom wall 112 with an outer circumferential surface thereof slightly protruding upward from the inner surface of the bottom wall 112 of the housing 110. In the present embodiment, two support rollers 111 separated from each other in the width direction of the roll body R are provided on the rear side of the bent portion 112*a*, and two support rollers 111 separated from each other in the width direction of the roll body R are provided on the front side of the bent portion 112*a*. Specifically, in the present embodiment, a total of four support rollers 111 are provided, two on the left side and two on the right side with the bent portion 112*a* sandwiched therebetween.

A rotating shaft (not shown) of each of the support rollers 111 is provided in parallel with a rotating shaft of the roll body R. An outer circumferential surface of the roll body R placed in the space above the bottom wall 112 is supported by contacting the outer circumferential surfaces of the four support rollers 111, and hardly contacts an inner surface of the bottom wall 112. For this reason, if the recording paper T is pulled out of the roll body R, the roll body R rotates and a plurality of support rollers 111 is rotated correspondingly. Regardless of the diameter of the roll body R, a central shaft of the roll body R is always positioned above the bent portion 112*a* of the bottom wall 112.

The cover body 120 includes a top wall 122 bent in an arcuate shape to cover the roll body R from above in the state in FIG. 2 in which the opening of the housing 110 is closed. The recording paper T pulled out of the roll body R is discharged from the printer 100 along the outer surface of the top wall 122, as described below. The top wall 122 has a size and shape at which the top wall 122 does not contact the outer circumferential surface of the unused roll body R with the maximum diameter supported by a plurality of support rollers 111 in the state in FIG. 2. A curvature radius of the top wall 122 is slightly greater than that of the bottom wall 112. Therefore, if the cover body 120 is pivoted to the fully open position in FIG. 1, a part of the top wall 122 overlaps with the outer side of the bottom wall 112.

The cover body 120 has two side walls 120*a* and 120*b* (FIG. 1) extending in parallel with each other in a longitudinal direction thereof. As shown in FIG. 2, in a state in which the cover body 120 is closed, an edge of the side wall 120*a* separated from the top wall 122 abuts against an edge of the side wall 110*c* of the housing 110, and an edge of the side wall 120*b* separated from the top wall 122 abuts against an edge of the side wall 110*d* of the housing 110. Thus, in a state in which the cover body 120 is closed, a housing section S serving as a space for accommodating the roll body R is formed between the housing 110 and the cover body 120. The housing section S has a substantially cylindrical shape horizontally laid down.

The printer 100 includes the buffer device 10, a printing and conveyance device 20 and a cutter 30.

The buffer device 10 applies tension to the recording paper T pulled out of the roll body R. The recording paper T pulled out of the roll body R is wound around a platen roller 22 described below. The buffer device 10 applies a pressing force in a direction towards the roll body R to the recording paper T between the roll body R and the platen roller 22 to change a conveyance path of the recording paper T, and meanwhile applies tension to the recording paper T. The buffer device 10 applies a braking force to the roll body R to brake the rotation of the roll body R only for a predetermined period until the diameter of the roll body R reaches a certain diameter from the start of use of the roll body R having the maximum diameter. The detailed structure and function of the buffer device 10 are described in detail below.

The printing and conveyance device 20 includes the platen roller 22 and a print head 24. The platen roller 22 rotates while sandwiching the wound recording paper T between the platen roller 22 and the print head 24 to apply a conveyance force to the recording paper T. In other words, the recording paper T is energized against the platen roller 22 by the print head 24 to obtain the conveyance force from the rotating platen roller 22. The platen roller 22 is provided at an end on the front side of the cover body 120. The print head 24 is provided on the front side of the opening of the housing 110. If the cover body 120 is closed with respect to the housing 110 in the state shown in FIG. 2, the platen roller 22 and the print head 24 are pressed against each other across the recording paper T at a predetermined pressure to sandwich the recording paper T to be capable of conveying the recording paper T.

The platen roller 22 is connected to a rotating shaft of a motor 23 via a plurality of gears (not shown) in the state in FIG. 2 in which the cover body 120 is closed with respect to the housing 110. The motor 23 is provided in the housing 110 and is driven based on a control signal from a control section (not shown). By rotating the motor 23, the platen roller 22 rotates to convey the recording paper T sandwiched between the print head 24 and the platen roller 22. The platen roller 22 and the print head 24 function as a conveyance section that pulls out the recording paper T from the roll body R to convey the recording paper T pulled out.

The print head 24 is, for example, a thermal head, and prints predetermined characters or images on the recording paper T conveyed between the outer circumferential surface of the platen roller 22 and the print head 24 based on a print signal transmitted from the control section (not shown). The print head 24 is pressed against the outer circumferential surface of the platen roller 22 via a spring 25. The print head 24 functions as a printing section.

A cutter 30 is arranged on a conveyance downstream side of the printing and conveyance device 20 in the conveyance path in which the recording paper T pulled out of the roll body R is conveyed. The cutter 30 includes a fixed blade 32 and a movable blade 34. The fixed blade 32 is arranged on the front side of the housing 110, as with the print head 24. The movable blade 34 is provided on the front side of the cover body 120, as with the platen roller 22. The movable blade 34 faces the fixed blade 32 across the conveyance path of the recording paper T in a state in which the cover body 120 is closed with respect to the housing 110 (i.e., the state in FIG. 2). In this state, by driving the movable blade 34, the recording paper T is cut between the movable blade 34 and the fixed blade 32. The recording paper T on which characters and the like are printed by the print head 24 is cut to a predetermined length by the cutter 30. After passing between the fixed blade 32 and the movable blade 34 and being cut to a predetermined length, the recording paper T is discharged from a discharge port 121 provided on the front side of the cover body 120 onto an outer surface of the top wall 122 of the cover body 120.

Figure 3:
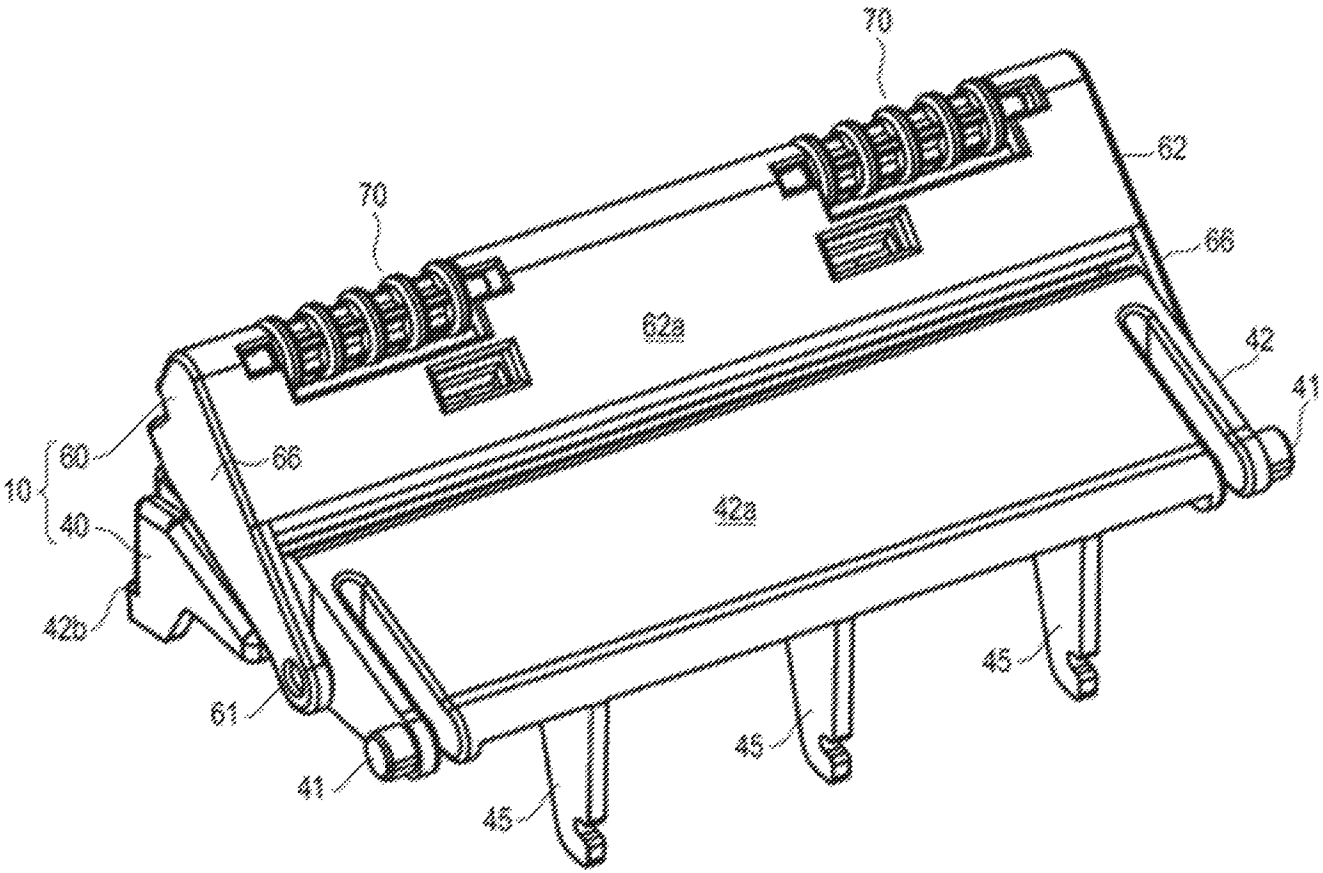
FIG. 3 is a perspective view illustrating a buffer device according to the embodiment incorporated into the printer in FIG. 1.
Figure 4:
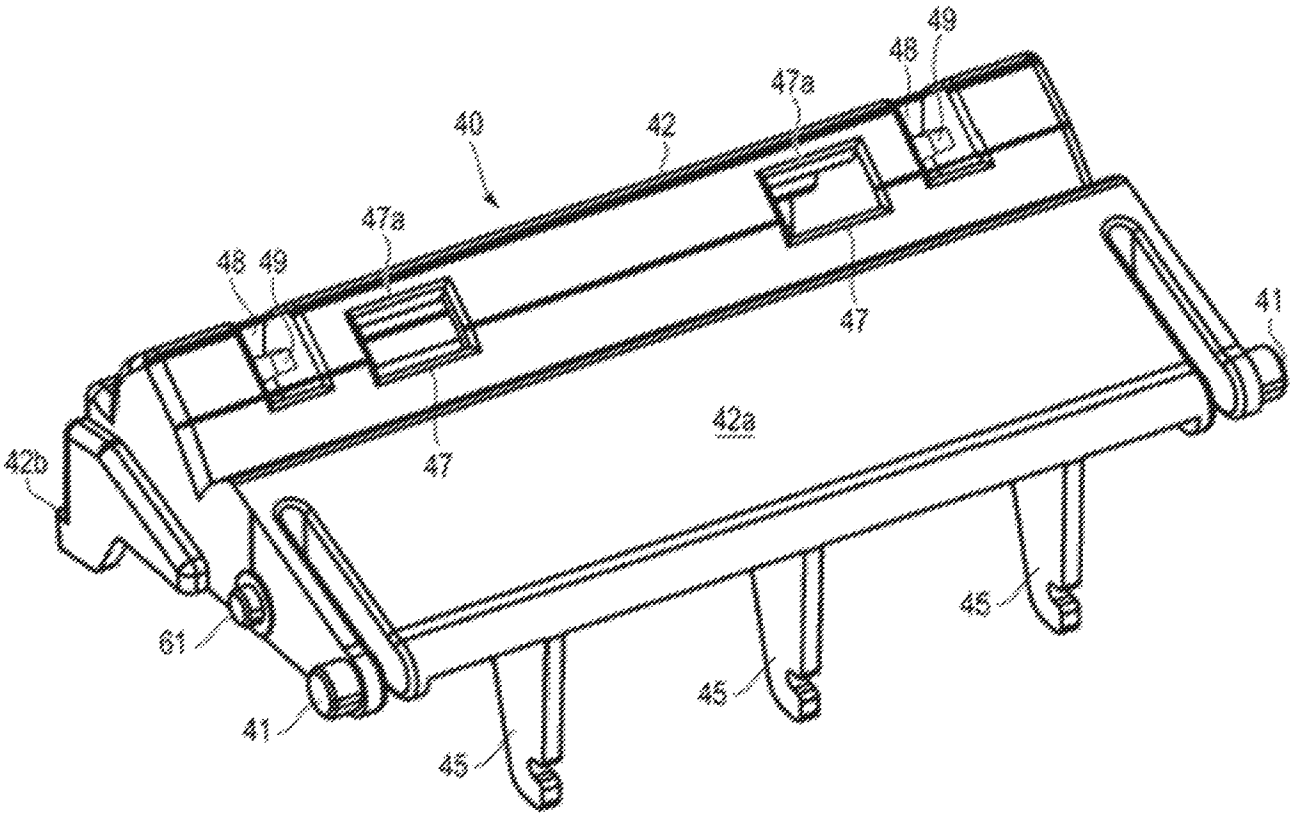
FIG. 4 is a perspective view illustrating a first damper of the buffer device in FIG. 3.
Figure 5:
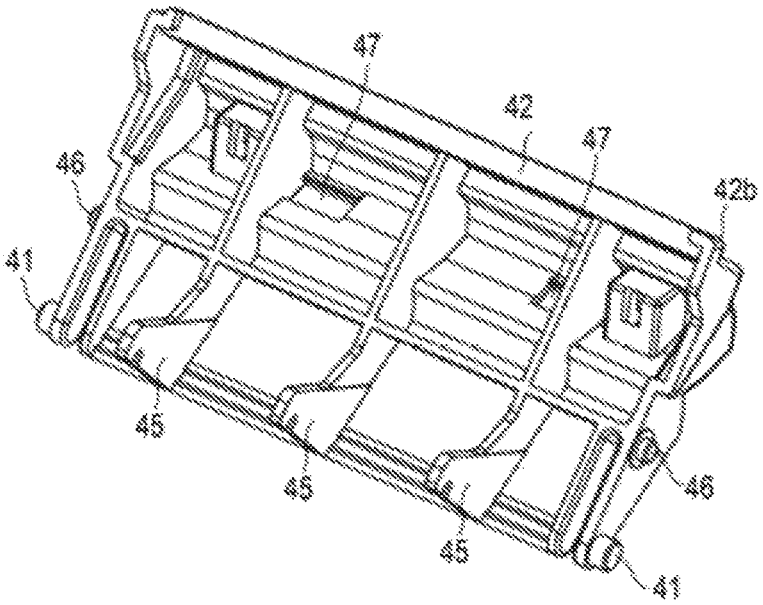
FIG. 5 is a perspective view illustrating the first damper in FIG. 4 as viewed from a back surface side.
Figure 6:
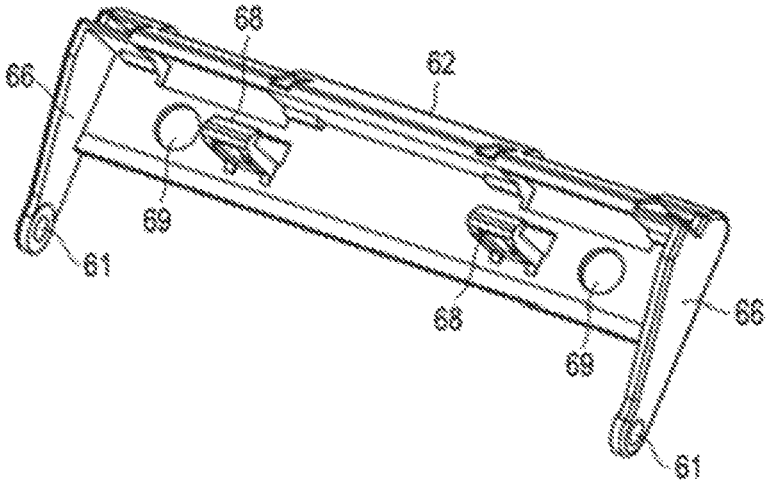
FIG. 6 is a perspective view illustrating a second damper of the buffer device in FIG. 3 as viewed from the back surface side.

Below, the structure of the buffer device 10 is described in detail with reference to FIG. 3 to FIG. 6. FIG. 3 is a perspective view illustrating main portions of the buffer device 10 as viewed from the roll body R (not shown here) side. FIG. 4 is a perspective view illustrating a state in which a second damper 60 is removed from the structure shown in FIG. 3. FIG. 5 is a perspective view illustrating a swinging member 42 of a first damper 40 as viewed from the back surface side. FIG. 6 is a perspective view illustrating a swinging member 62 of the second damper 60 as viewed from the first damper 40 side on the back surface side.

The buffer device 10 includes the first damper 40 and the second damper 60. The buffer device 10 of the present embodiment is a double damper in which the first damper 40 that generates a relatively stronger pressing force and the second damper 60 that generates a relatively weaker pressing force cooperate with each other. The first damper 40 includes the swinging member 42 (i.e., a first swinging member) shown in FIG. 3 to FIG. 5, and three tension springs 44 (i.e., first energization members) shown in FIG. 2 (only one is shown in FIG. 2). The second damper 60 includes the swinging member 62 (i.e., a second swinging member) shown in FIG. 3 and FIG. 6, and two compression springs 64 (i.e., second energization members) shown in FIG. 2 (only one is shown in FIG. 2).

The swinging member 42 of the first damper 40 includes two pivot shafts 41 (i.e., first pivot shafts) protruding in mutually separated directions from both ends in a longitudinal direction of the swinging member 42. The two pivot shafts 41 are arranged at positions closer to one end side (i.e., a swinging base end side) of the swinging member 42 in a lateral direction, and are arranged coaxially with each other. The bottom wall 112 of the housing 110 includes support portions (not shown) that support the two pivot shafts 41 of the swinging member 42 in a pivotable manner at two positions separated in the axial direction of the roll body R. Specifically, the support portions of the housing 110 support the two pivot shafts 41 of the swinging member 42 in a direction parallel to the shaft of the roll body R. The swinging member 42 is arranged along the bottom wall 112 in such a posture that a surface 42*a* thereof faces the roll body R and the pivot shaft 41 is arranged on a side close to the bent portion 112*a* of the bottom wall 112. The swinging member 42 is mounted on the bottom wall 112 in a swingable manner in such a posture that a longitudinal direction of the swinging member 42 is parallel to the axial direction of the roll body R.

The swinging member 42 integrally includes three hooks 45 protruding from a back surface side thereof in a direction substantially orthogonal to the back surface. The three hooks 45 are provided on the back surface side to protrude from a position closer to one end of the swinging member 42 in the lateral direction. Specifically, the base ends of the three hooks 45 are close to the pivot shaft 41. The three hooks 45 are arranged separated from each other in the longitudinal direction of the swinging member 42. One end of each tension spring 44 is hooked on the tip of each hook 45.

The other ends of the three tension springs 44 are respectively hooked on three hooks 114 (FIG. 2) protruding from the back surface side of the bottom wall 112 of the housing 110. The three hooks 114 on the bottom wall 112 side are respectively provided at positions facing in a mutually separated manner the front side of the three hooks 45 of the swinging member 42.

Each of the tension springs 44 is stretched between the hook 45 of the swinging member 42 and the hook 114 on the housing 110 side in a slightly stretched state. For this reason, a swinging tip of the swinging member 42 is always energized in a pivot direction (clockwise direction in FIG. 2) towards the roll body R by a restoring force of the three tension springs 44.

The swinging member 42 of the first damper 40 has a step portion 42*b* engaged with an edge 112*b* (FIG. 2) of the bottom wall 112 of the housing 110 at the tip of the pivot. As described above, the swinging member 42 is energized in the direction towards the roll body R by the three tension springs 44, and further pivot thereof is restricted by engaging the step portion 42*b* with the edge 112*b* (regulating member) of the bottom wall 112. In the state in FIG. 2 in which the step portion 42*b* of the swinging member 42 is engaged with the edge 112*b* of the bottom wall 112, the both ends of each of the three tension springs 44 are slightly stretched, and at least the restoring force is applied.

Specifically, a pivotable range of the swinging member 42 of the first damper 40 is between a position shown in FIG. 2 at which the step portion 42*b* of the swinging member 42 is engaged with the edge 112*b* of the bottom wall 112 and a position at which a part of the swinging member 42 abuts against a tip of a stopper 112*c* (regulating member) arranged integrally with the bottom wall 112 of the housing 110. The swinging member 42 is energized in a clockwise direction in FIG. 2 around the pivot shaft 41 by the restoring force of the tension spring 44 at any pivot position within the pivotable range described above.

The swinging member 42 of the first damper 40 has two pivot shafts 46 (i.e., second pivot shafts) for supporting the swinging member 62 of the second damper 60 in a swingable manner. The two pivot shafts 46 are arranged at separated positions from the pivot shafts 41 of the first damper 40 described above to the swinging tip of the swinging member 42 along the lateral direction of the swinging member 42. The two pivot shafts 46 are coaxially extended in mutually separated directions from both ends of the swinging member 42 in the longitudinal direction. The swinging member 62 of the second damper 60 is superposed on the swinging member 42 in a direction in which the back surface thereof faces the surface of the swinging member 42 of the first damper 40. Specifically, the swinging member 62 of the second damper 60 is arranged between the swinging member 42 of the first damper 40 and the roll body R as shown in FIG. 2.

The swinging member 62 of the second damper 60 has plate-like support arms 66 at both ends in the longitudinal direction thereof. The both support arms 66 extend along the lateral direction of the swinging member 62 in a mutually parallel posture. The swinging member 62 has two shaft holes 61 that receive the pivot shaft 46 of the swinging member 42 at the base end of the pivot of each support arm 66. The two shaft holes 61 are provided coaxially along the longitudinal direction of the swinging member 62.

The swinging member 62 of the second damper 60 includes two engaging claws 68 (FIG. 6) on the back surface side thereof at positions separated from the shaft holes 61 described above in the lateral direction thereof. The two engaging claws 68 protrude in a direction substantially orthogonal to the back surface of the swinging member 62 in an integrated manner. The two engaging claws 68 are arranged separated from each other in the longitudinal direction of the swinging member 62. On the other hand, the swinging member 42 of the first damper 40 includes two engaging holes 47 (FIG. 4) at positions respectively facing the two engaging claws 68 of the swinging member 62 of the second damper 60. If the swinging member 62 of the second damper 60 pivots about the pivot shaft 46 and the two engaging claws 68 are inserted to the engaging holes 47 of the swinging member 42 of the first damper 40, the engaging claws 68 are elastically deformed to be hooked on edges 47*a* of the engaging holes 47.

The swinging member 42 of the first damper 40 has two recesses 48 on a surface thereof each for receiving one end of each of two compression springs 64 (second energization members). The two recesses 48 are respectively provided on the outer sides in the longitudinal direction of the two engaging holes 47 described above at the swinging tip side of the swinging member 42 that is separated from the pivot shaft 41 in the lateral direction. Each recess 48 has a protrusion 49 inserted into one end of the compression spring 64. On the other hand, the swinging member 62 of the second damper 60 has two circular recesses 69 (FIG. 6) on a back surface thereof each for receiving the other end of each of the two compression springs 64. The two recesses 69 are provided on the outer sides in the longitudinal direction of the two engaging claws 68 described above at positions facing the two recesses 48 of the swinging member 42 of the first damper 40, respectively.

Figure 7:
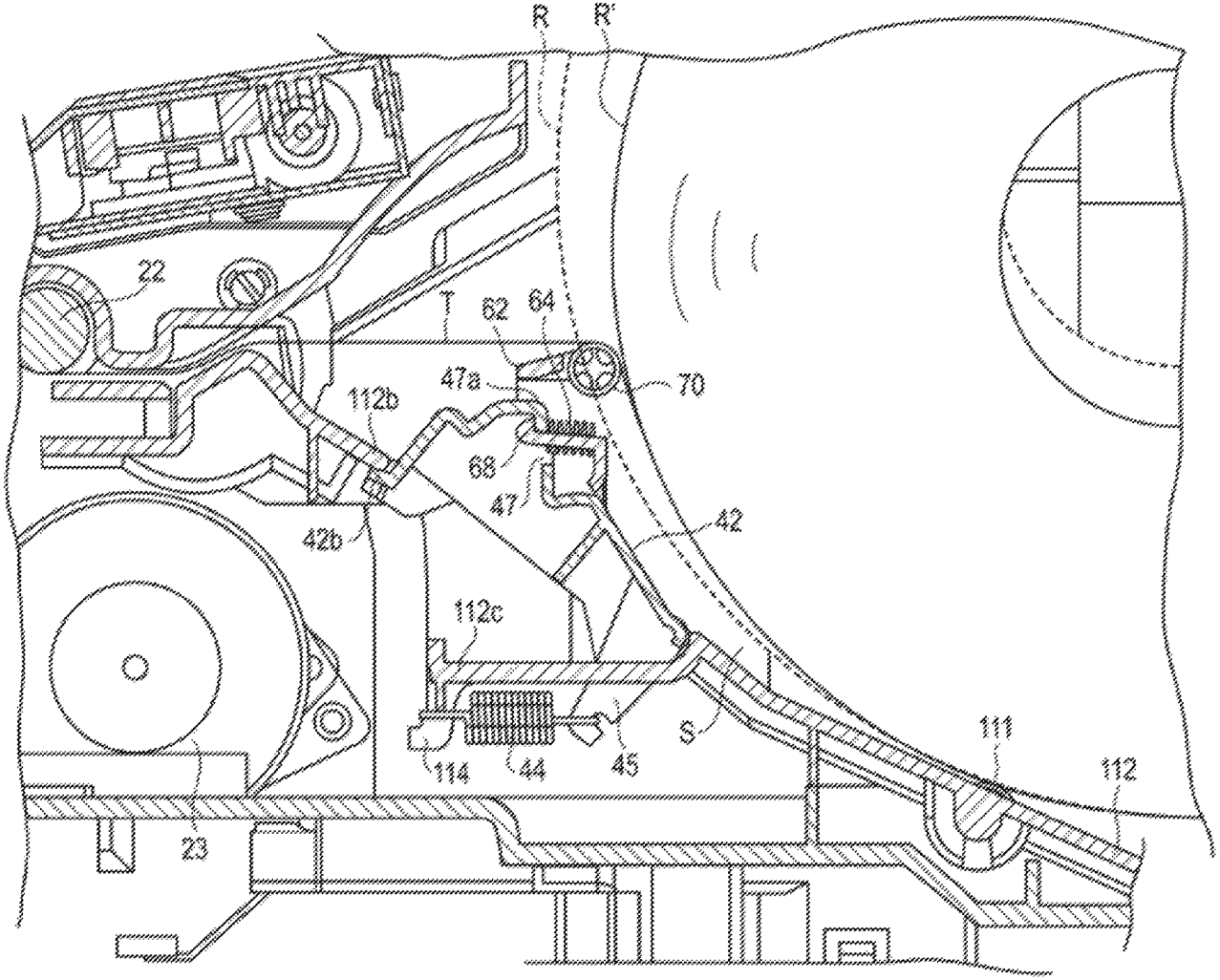
FIG. 7 is an enlarged sectional view illustrating a state of the buffer device when a diameter of a roll body in FIG. 2 is reduced.

The two compression springs 64 are respectively attached between the recesses 48 of the swinging member 42 of the first damper 40 and the recesses 69 provided on the back surface of the second damper 60. As shown in FIG. 7, in a state in which the compression spring 64 is arranged between the swinging member 42 and the swinging member 62, if the engaging claw 68 of the swinging member 62 is hooked on the edge 47*a* of the engaging hole 47 of the swinging member 42, the compression spring 64 is compressed. In this state, the swinging member 62 of the second damper 60 is energized in a direction towards the roll body R (clockwise direction in FIG. 7) around the pivot shaft 46 with respect to the swinging member 42 of the first damper 40. In the state in FIG. 7 in which the engaging claw 68 is hooked on the edge 47*a* of the engaging hole 47, the swinging of the swinging member 62 of the second damper 60 in the direction towards the roll body R is restricted.

The pivotable range of the swinging member 62 of the second damper 60 relative to the swinging member 42 is between a position (shown in FIG. 7) at which the engaging claw 68 of the swinging member 62 is hooked on the edge 47*a* of the engaging hole 47 of the swinging member 42 and a position (not shown) at which a back surface of the swinging member 62 contacts the surface 42*a* of the swinging member 42. The swinging member 42 is energized in the clockwise direction in FIG. 2 around the pivot shaft 46 by the restoring force of the compression spring 64 at any pivot position within the pivotable range. When viewed from a fixed system of the printer 100, the pivotable range of the second damper 60 is a combination of a pivotable range relative to the first damper 40 and a pivotable range of the first damper 40.

As shown in FIG. 3, the second damper 60 has two sets of pivotable pressing rollers 70 (pressing members) on the swinging tip side of the swinging member 62 pivoting around the pivot shaft 46, i.e., on a surface 62*a* side of the swinging member 62. The two sets of pressing rollers 70, each of which includes a plurality of roller portions arranged coaxially in a mutually separated manner, are arranged separated from each other in the longitudinal direction of the swinging member 62. The two sets of pressing rollers 70 press the recording paper T (wound around the roll body R) pulled out of the roll body R towards the roll body R at two positions separated from each other in a width direction of the recording paper T.

Figure 8:
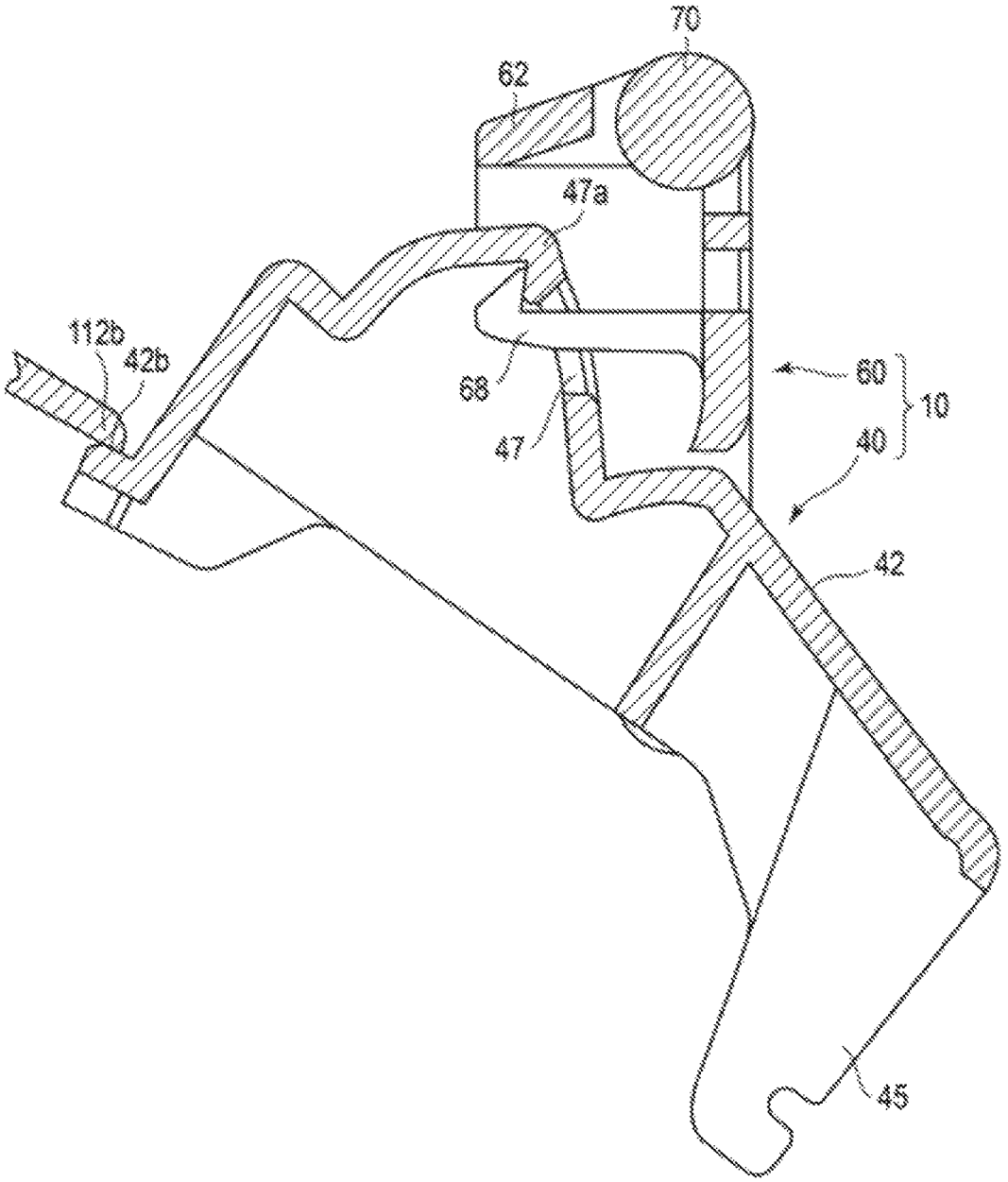
FIG. 8 is a partially enlarged sectional view illustrating main portions in FIG. 7.

Below, a function of the buffer device 10 described above is described mainly with reference to FIG. 2, FIG. 7, and FIG. 8. FIG. 7 shows a state in which the housing section S accommodates a roll body R' being used after the recording paper T is pulled out of the unused roll body R with the maximum diameter to some extent. In FIG. 7, an outer circumferential surface of the roll body R with the maximum diameter is indicated by a broken line for comparison. FIG. 8 is an enlarged sectional view illustrating main portions in FIG. 7.

As shown in FIG. 2, in a state in which the unused roll body R with the maximum diameter is accommodated in the housing section S, and the recording paper T is pulled out of the roll body R and passes between the platen roller 22 and the print head 24, the pressing roller 70 of the buffer device 10 is in contact with the outer circumferential surface of the roll body R. Specifically, in this state, almost no tension is applied to the recording paper T pulled out of the roll body R, and therefore the recording paper T is pressed against the roll body R by the pressing roller 70.

In other words, in this state, the engaging claw 68 of the swinging member 62 of the second damper 60 is not engaged with the edge 47*a* of the engaging hole 47 of the swinging member 42 of the first damper 40. Specifically, the swinging member 62 is positioned within the pivotable range. For this reason, in this state, the two sets of pressing rollers 70 are pressed against the outer circumferential surface of the roll body R by the restoring force of the two compression springs 64. Specifically, in the present embodiment, the buffer device 10 is positioned so as to approach the roll body R until a position at which the two sets of pressing rollers 70 are at least pressed against the outer circumferential surface of the roll body R in a state in which the roll body R with the maximum diameter is accommodated in the housing section S.

On the other hand, in the state shown in FIG. 2, the step portion 42*b* of the swinging member 42 of the first damper 40 is engaged with the edge 112*b* of the bottom wall 112 of the housing 110, thereby restricting the swinging of the swinging member 42 in a direction towards the roll body R. Specifically, in this state, the restoring force of the three tension springs 44 does not act on the pressing roller 70, and thus, a relatively weak pressing force acts on the recording paper T.

From this state, if the motor 23 is energized to rotate the platen roller 22 in a predetermined direction (clockwise direction in the drawing), a conveyance force is applied to the recording paper T by the platen roller 22, and in this way, the recording paper T is pulled out of the roll body R. At this time, since the roll body R attempts to keep stopping due to its inertia, a relatively large tension acts on the recording paper T between the roller body R and the platen roller 22 immediately after an operation of pulling out the recording paper T is started (until the roll body R starts to rotate). At this time, the tension applied to the recording paper T increases as the mass (i.e., the diameter) of the roll body R becomes large.

For this reason, immediately after the start of the rotation of the platen roller 22, the pressing roller 70 of the buffer device 10 is pushed back in a direction away from the roll body R by the tension of the recording paper T. At this time, first, the swinging member 62 of the second damper 60 provided with the pressing roller 70 swings in a counterclockwise direction in the drawing as the two compression springs 64 are compressed. Furthermore, after the back surface of the swinging member 62 of the second damper 60 contacts the surface 42*a* of the swinging member 42 of the first damper 40, as the three tension springs 44 are extended, the swinging member 42 of the first damper 40 swings in the counterclockwise direction in the drawing.

As described above, according to the buffer device 10 of the present embodiment, even if a large tension is applied to the recording paper T immediately after the conveyance of the recording paper T is started, an impact on the recording paper T can be absorbed, and problems such as cut of the recording paper T or an unstable conveyance speed of the recording paper T can be prevented. When the roll body R starts rotating after the start of the conveyance of the recording paper T, the pressing roller 70 of the buffer device 10 moves within the pivotable range in accordance with the change in the tension of the recording paper T, and the recording paper T can be conveyed stably.

On the other hand, when the printer 100 finishes a printing operation and the control section stops energization to the motor 23 to stop the platen roller 22, the roll body R being rotating in the housing section S attempts to continue rotating due to its inertia. At this time, an inertial force by which the roll body R attempts to continue rotating increases as the mass of the roll body R becomes large. As described above, if the roll body R continues rotating after the platen roller 22 is stopped, the recording paper T becomes slack between the roll body R and the platen roller 22. If the recording paper T is slack, there is a possibility that the recording paper T is stained or jammed. For this reason, it is desirable to stop the roll body R rapidly after the platen roller 22 is stopped.

In the present embodiment, as shown in FIG. 7, the buffer device 10 is positioned at a position at which the pressing roller 70 overlaps the roll body R beyond an imaginary outer circumferential surface of the roll body R with the maximum diameter (indicated by the broken line in FIG. 7) in a state in which the pressing roller 70 is positioned at one end of the pivotable range that protrudes towards the housing section S most. For this reason, according to the present embodiment, the pressing roller 70 can contact the outer circumferential surface of the roll body R in a state in which no tension is applied to the recording paper T in a certain period from the start of the use of the unused roll body R with the maximum diameter (until the outer circumferential surface is separated from the pressing roller 70 protruding most, like the roll body R' being used and provided with the outer circumferential surface indicated by a solid line in FIG. 7).

Specifically, according to the buffer device 10 of the present embodiment, immediately after the platen roller 22 is stopped and no tension acts on the recording paper T, the pressing roller 70 can be pressed against the outer circumferential surface of the roll body R at a predetermined pressure. For this reason, a certain braking force can be applied to the roll body R that attempts to continue rotating after the printing operation is finished, and in this way, the rotation of the roll body R can be rapidly stopped. Therefore, according to the present embodiment, the stain or a conveyance jam caused by the slack of the recording paper T can be prevented.

During a predetermined period from the start of use of the roll body R with the maximum diameter (i.e., until the pressing roller 70 does not contact the roll body R), the buffer device 10 can apply the braking force to the roll body R as described above. However, after the diameter of the roll body R is decreased to such an extent that the pressing roller 70 does not contact the roll body R, the buffer device 10 cannot apply the braking force to the roll body R. As described above, the inertial force of the inertia by which the roll body R attempts to continue rotating is increased as the mass of the roll body R becomes large. Specifically, since the problem such as the slack of the recording paper T is difficult to occur even if no braking force is applied to the roll body R' whose mass is reduced to some extent, as in the present embodiment, it is effective to apply the braking force at the beginning of the use of the roll body R with the maximum diameter.

According to the present embodiment, since the buffer device 10 is mounted on the bottom wall 112 of the housing 110, the printer 100 can be downsized. However, if the buffer device 10 is mounted on the bottom wall 112 of the housing section S for accommodating the roll body R as in the present embodiment, there is a concern that a buffer performance is reduced due to narrowing of the pivotable range of the pressing roller 70 for applying the tension to the recording paper T. As a countermeasure, in the present embodiment, the buffer device 10 is mounted at a position at which the roll body R with the maximum diameter and the pivotable range of the pressing roller 70 partially overlap.

Therefore, in the buffer device 10 of the present embodiment, the pivotable range of the pressing roller 70 is maximized at a time point at which the diameter of the roll body R becomes equal to that of the roll body R' that is indicated by the solid line in FIG. 7. Specifically, according to the present embodiment, a sufficient pivotable range of the pressing roller 70 can be ensured while the device configuration is downsized, and undesired slack of the recording paper T can be prevented.

In the buffer device 10 of the present embodiment, the tension spring 44 is used as the first energization member for energizing the swinging member 42 of the first damper 40, and the compression spring 64 is used as the second energization member for energizing the swinging member 62 of the second damper 60. This combination is suitable for relatively increasing the pressing force by the first damper 40 and relatively decreasing the pressing force by the second damper 60. In the present embodiment, the tension spring 44 is provided in a space between the swinging member 42 of the first damper 40 and the housing 110, and the compression spring 64 is provided in a space between the swinging member 42 of the first damper 40 and the swinging member 62 of the second damper 60, thereby downsizing the device configuration.

According to the printer 100 of the embodiment described above, since the buffer device 10 is mounted on the bottom wall 112 of the housing 110, the device configuration can be downsized. According to the buffer device 10 of the present embodiment, the pressing roller 70 is energized in the direction of pressing against the roll body R. For this reason, the slack of the recording paper T can be suppressed by applying the braking force to the roll body R with the maximum diameter. In this way, the recording paper T can be prevented from being stained or jammed. According to the present embodiment, the buffer device 10 is arranged in such a manner that a part of the pivotable range of the pressing roller 70 overlaps with the outer circumferential surface of the roll body R with the maximum diameter. In this way, at a time point at which the diameter of the roll body R' being used is reduced to some extent, the pivotable range of the pressing roller 70 can be maximized, and the buffer performance can be maintained.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

For example, in the above-described embodiment, the recording paper is used as the image receiving medium;

however, it is not limited thereto, and a medium other than the paper may be used. In the above-described embodiment, the platen roller 22 and the print head 24 are used as the conveyance section; however, it is not limited thereto, and another conveyance device that applies a conveyance force to the recording paper T may be provided separately.

What is claimed is:

1. A printer, comprising:

a housing section configured to accommodate a roll body obtained by winding an image receiving medium in a roll shape; a conveyance section configured to pull the image receiving medium from the roll body to convey the image receiving medium in a conveyance direction;

a printing section configured to print on the image receiving medium pulled from the roll body by the conveyance section; and a buffer device arranged at a bottom of the housing section on an upstream side of the conveyance section along a direction in which the image receiving medium is pulled in the conveyance direction so as to apply a pressing force to the image receiving medium pulled from the roll body in a direction towards the roll body, wherein the buffer device comprises a pressing member that presses the image receiving medium, and is arranged at a position at which the pressing member is pressed against the roll body with a maximum diameter, wherein the buffer device comprises a first damper including a first swinging member provided at the bottom of the housing section configured to swing around a first pivot shaft, and a first energization member for energizing the first swinging member towards the roll body; and a second damper including a second swinging member configured to swing around a second pivot shaft with respect to the first swinging member and provided with the pressing member at a swinging tip thereof, and a second energization member for energizing the second swinging member towards the roll body, wherein the first energization member is a tension spring stretched between the first swinging member and the bottom of the housing section, and wherein the second energization member is a compression spring provided in a compressed state between the first swinging member and the second swinging member.

2. The printer according to claim 1, wherein a housing of the housing section includes a regulating member that regulates a pivotable range of the first swinging member.

3. The printer according to claim 1, wherein the housing comprises a bottom wall positioned on a rear side and having a substantially arcuate shape that curves from a rear side end of an opening towards a front side end thereof.

4. The printer according to claim 3, wherein a curvature radius of the bottom wall is greater than a curvature radius of the roll body having a maximum diameter.

5. The printer according to claim 3, wherein the bottom wall has a size in a width direction that is greater than a width in an axial direction of the roll body.

6. The printer according to claim 1, wherein the buffer device is configured to apply a braking force to the roll body to brake a rotation of the roll body for a predetermined period until a diameter of the roll body reaches a certain diameter from a start of use of the roll body having a maximum diameter.

7. The printer according to claim 1, wherein the buffer device is configured to apply a pressing force in a direction towards the roll body to the image receiving medium between the roll body and a platen roller to change a conveyance path of the image receiving medium, and further configured to apply tension to the image receiving medium.

* * * * *